United States Patent [19]

Priesemuth

[11] Patent Number: 4,807,540

[45] **Date of Patent: * Feb. 28, 1989**

[54] ARRANGEMENT OF WORK LOCATIONS

[76] Inventor: Wolfgang Priesemuth, Postkamp 13, D-2210 Itzehoe-Nordoe, Fed. Rep. of Germany

[ * ] Notice: The portion of the term of this patent subsequent to Nov. 17, 2004 has been disclaimed.

[21] Appl. No.: 93,013

[22] Filed: Sep. 4, 1987

Related U.S. Application Data

[63] Continuation of Ser. No. 791,221, Oct. 25, 1985, Pat. No. 4,706,572.

[51] Int. Cl.[4] ..... A47B 57/00

[52] U.S. Cl. ..... 108/60; 108/66

[58] Field of Search ..... 108/60, 66, 64, 65; 272/132

[56] References Cited

U.S. PATENT DOCUMENTS

| | | | |
|---|---|---|---|
| 227,780 | 5/1880 | Hodge | 222/132 |
| 1,840,595 | 1/1932 | Moore | 222/132 X |
| 2,652,307 | 9/1953 | Harazim | 108/60 X |
| 2,709,954 | 6/1955 | Baker | 108/50 X |
| 2,970,874 | 2/1961 | Honeycutt et al. | 108/60 X |
| 3,083,417 | 4/1963 | Cook | 108/60 X |
| 3,361,090 | 1/1968 | Howlett | 108/60 X |
| 3,698,104 | 10/1972 | Sutton | 108/60 X |
| 3,971,327 | 7/1976 | Critchett | 108/60 |
| 4,248,162 | 2/1981 | Skeist | 108/50 |
| 4,378,727 | 4/1983 | Doss | 108/50 X |
| 4,706,572 | 11/1987 | Priesmuth | 108/60 |

FOREIGN PATENT DOCUMENTS

| | | | |
|---|---|---|---|
| 618804 | 2/1949 | United Kingdom | 108/64 |

*Primary Examiner*—Kenneth J. Dorner
*Assistant Examiner*—José V. Chen
*Attorney, Agent, or Firm*—Becker & Becker

[57] ABSTRACT

A ring-shaped arrangement of individual work locations. Tables which are preferably trapezoidal are arranged in a ring, in the middle of which is disposed a region which is free of table tops, and in which can be disposed common supply lines or the like. The individual work locations, which are arranged around the central region, are respectively separated from an adjacent table by a vertical partition in which is disposed a material-transfer opening. The supply of material to the individual work locations can be effected from supply bins disposed on a shelf supported above the ring-shaped table top on the upper edges of the radially directed partitions. If it is a question of small parts, the latter can be transferred to the work location via conveying tubes, which lead from the supply bins on the shelf to the table top of the individual work locations.

8 Claims, 3 Drawing Sheets

ARRANGEMENT OF WORK LOCATIONS

This is a continuation of copending parent application Ser. No. 791,221 Priesemuth filed Oct. 25, 1985, now U.S. Pat. No. 4,706,572 Priesemuth dated Nov. 17, 1987 and commonly owned herewith.

BACKGROUND OF THE INVENTION

1. Field of the Invention

The present invention relates to an arrangement of work locations for the mass production of small, complex units.

2. Description of the Prior Art

During mass production, especially production of small electrical or mechanical components, elongated tables, a slowly moving conveyer belt, or even a combination of an elongated table along with a conveyer belt which extends parallel thereto, is generally used. In such a case, the work locations are disposed one after the other along the work table. The drawback to this is that a relatively large amount of space is required, since each individual work location needs its own supply lines, which are then generally provided in the vicinity of the ceiling or in non-transversed and not-usable edge of the work space.

An object of the present invention is to provide an improved work location arrangement where the supply lines, for example for power, compressed air, welding gas, inert gas, suction air, water, discharge, etc. can be significantly shorter, and thus take up less space.

BREIF DESCRIPTION OF THE DRAWINGS

This object, and other objects and advantages of the present invention, will appear more clearly from the following specification in conjunction with the accompanying drawings, in which.

SUMMARY OF THE INVENTION

The inventive arrangement of work locations is characterized primarily by a table having a basically ring-shaped table top that is divided into individual sectors, each of which provides one of the work locations about the periphery of the table; the center of the table is provided with a region that is free of a table top, with supply lines, such as for power, lighting, gas, air, water, discharge, gas venting, etc., being disposed in the central region for all of the work locations.

Preferably, a plurality of work tables having trapezoidal table tops are provided. These work tables have essentially identical shapes, with their slanted table edges abutting one another and encircling the central region, which preferably has a polygonal shape.

Not only does the inventive arrangement lead to a considerably reduced requirement for supply lines, but also leads to an improved utilization of the working space and a reduction of the danger of accidents caused by unfavorably laid cables or lines which can get in the way when somebody passes through the working space or during the transport of material.

Further details of the invention will be described subsequently.

DESCRIPTION OF PREFERRED EMBODIMENTS

Figure 3:
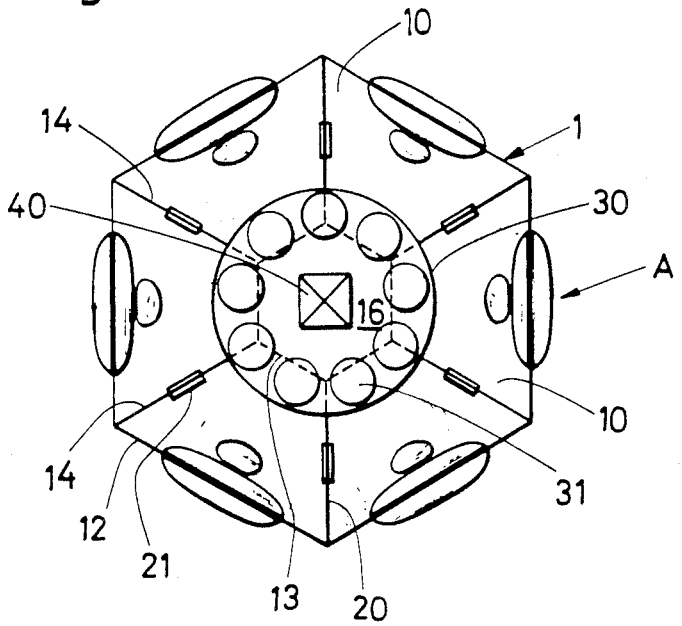
FIG. 3 is a schematic plan view of one inventive embodiment of a work location arrangement.

Referring now to the drawings in detail, the basic layout of the present invention is shown in FIG. 3. The ring-shaped table 1 comprises six individual work tables 10, each having a trapezoidal table top 11. The individual tables 10 are assembled in such a way that the side edges 14 of one table abut the side edges 14 of adjacent tables. In this way there results a ring-shaped table arrangement with a free central region 16 in which are located the supply lines 40, which are schematically indicated by a square in FIG. 3. The individual workers or operators A are seated on non-illustrated chairs placed in front of the outer edges 12 of the individual work tables 10. The inner edges 13 of the table tops delimit the central region 16, which is free of table tops.

Figure 1:
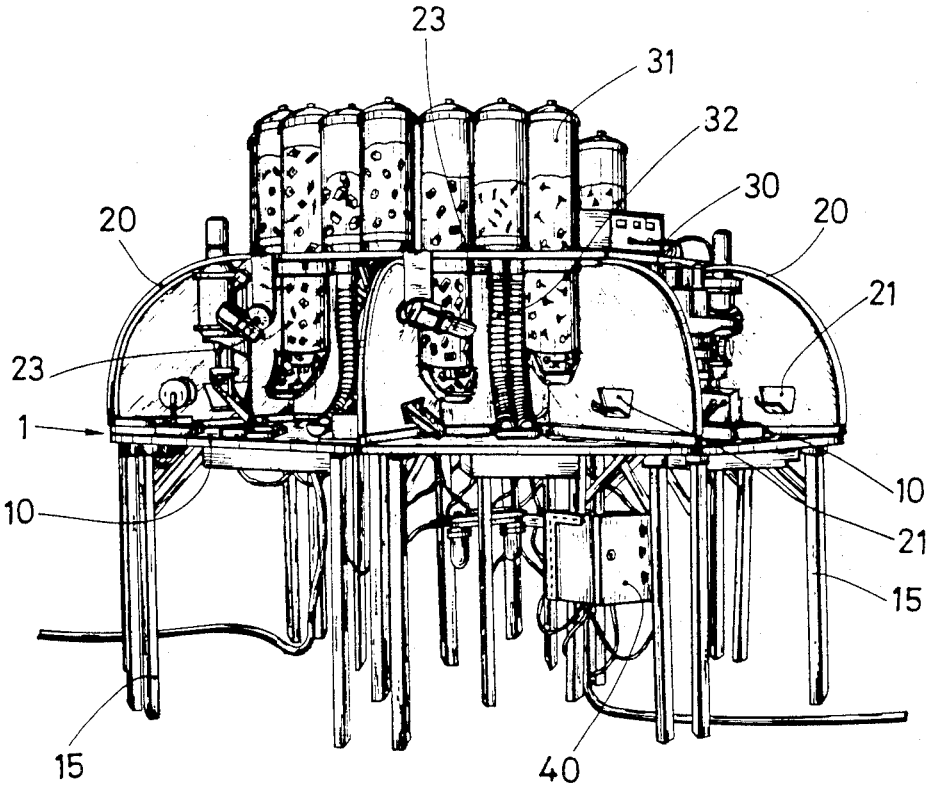
FIG. 1 is a perspective view of one inventive embodiment of a work location arrangement with the seating accommodations which are provided for the operators around the table being removed.
Figure 2:
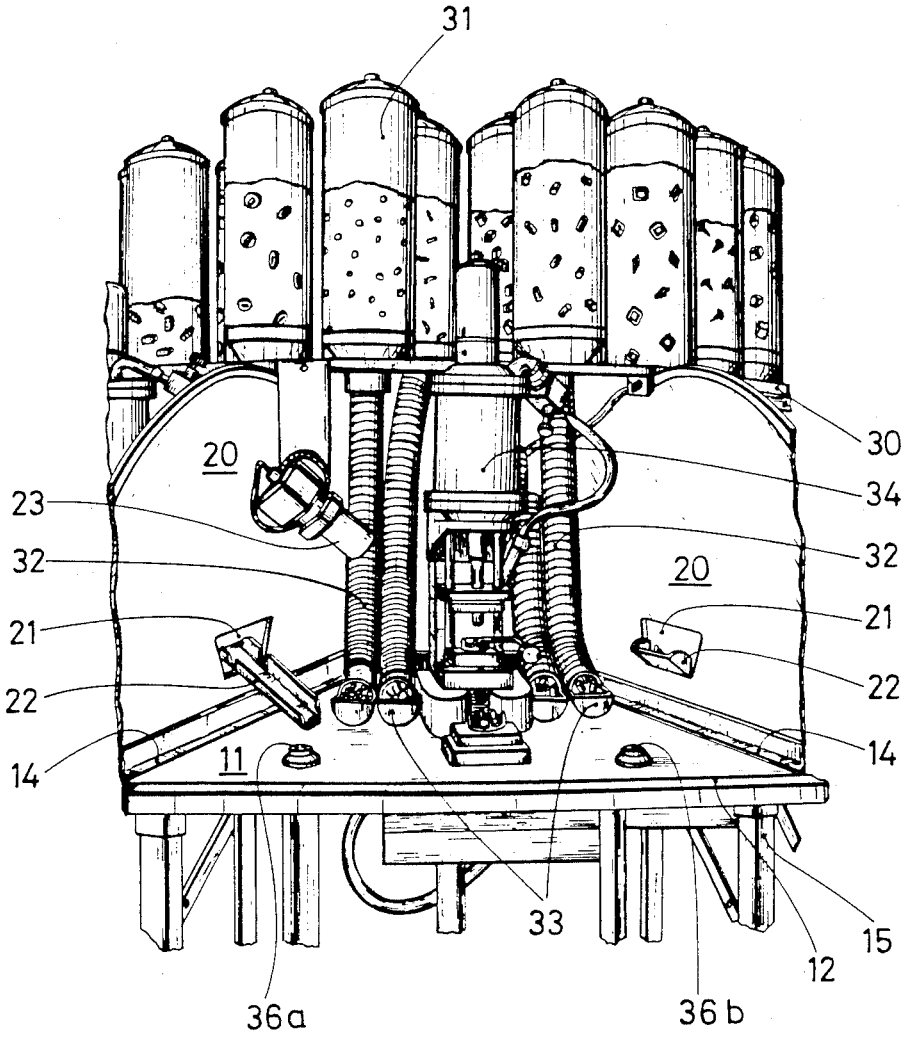
FIG. 2 is an enlarged view of a portion of the arrangement of FIG. 1.

Radially directed partitions 20, in which are disposed material-transfer openings 21, are located in the region of the slanted side edges 14 in order to separate the individual work locations. In this manner, the operators who are seated about the periphery of the ring-shaped table 1 do not disturb one another. The transfer of the components which are to be mass produced is effected via the openings 21 in the partitions 20. As shown in FIGS. 1 and 2, these transfer openings 21 can also be provided with a chute 22.

Figure 4:
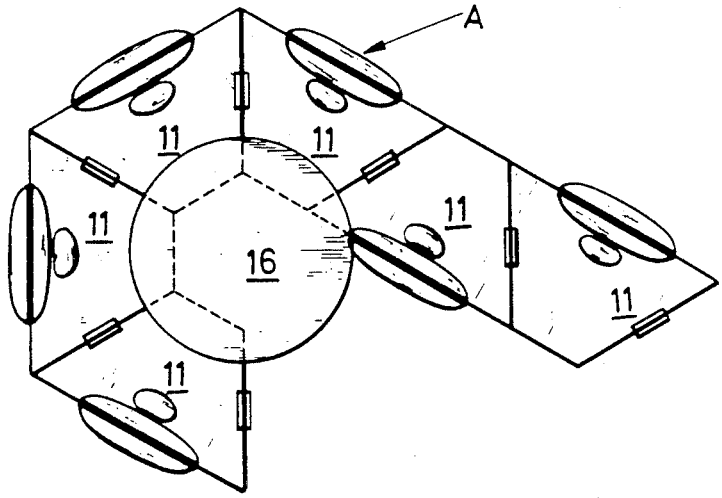
FIG. 4 is a schematic plan view of another inventive arrangement of a work location arrangement where the work location ring is opened and is connected to a linear work table section.

As can be seen in FIG. 1, each of the individual work tables 10 is provided with its own table legs 15, so that the work location arrangement can be very easily disassembled for storage, modification, or repair. Furthermore, this separate construction of the ring-shaped table makes it possible to have a construction similar to that shown in FIG. 4. If, assuming the configuration of FIG. 4, the mass produced articles generated on a circular path have to be fed to a linear conveying section, two of the six work tables can be removed from the circle and can be placed next to one another and adjacent to the last work table which is still located in the circle. Of course, it is also readily possible to take any number of work tables having a trapezoidal table top and to assemble them in a continuous linear work table arrangement. Thus, the inventive arrangement of work locations is extremely versatile with only a relatively few individual components which can be easily handled.

As shown in FIGS. 1 and 2, the radially directed vertical partitions 20, which are preferably transparent and are made of plastic, support a shelf 30 that can either extend over the entire open central region 16 of the ring-shaped work table 1, or can also be open in the middle if supply lines have to be fed to the table from the ceiling of the room.

The shelf 30 supports a plurality of supply bins 31, which are preferably made of impact-resistant synthetic material which is also transparent so that one can always see how full these bins 31 are. Contained in the bins 31 are the small parts which are to be worked with, such as preformed plastic elements, small metal parts, screws or bolts, rivets, knife-switch prongs, etc., depending upon the type of production provided. The supply bins 31 communicate via conveying tubes 32 with the individual work locations where the appropriate components are to be handled. The bottom end of the conveying tubes, to the extent necessary, can be provided with a bird bath-like withdrawal dish 33.

The work of an operator sitting at a work location will be described in conjunction with FIG. 2. A pneumatically operated work machine 34, such as a punch, a press, a riveting device, etc., is provided in the middle of a work location. The work location, especially the work machine 34 which is to be loaded, is illuminated by a lamp 23 which is suspended on a universal joint, and can be directed in any direction. The operator who is seated at the work location illustrated in FIG. 2 receives the prefabricated parts, for example from the adjacent work location on the left, via the material-transfer opening 21, in which is disposed a conveying chute 22. The prefabricated part is then placed by this operator in the work machine 34 and is combined with further small components which are then connected with the work piece when the operator pushes the buttons 36*a* and 36*b*, which for reliability reasons are provided in duplicate. The workpiece which is further processsed or completed in this manner is then passed along by the operator to the work location on his right; this is done by placing the workpiece on the chute 22 of the transfer opening 21 located on the right. The operator removes the components which are to be used at the work machine from the withdrawal dishes 33, which communicate via the conveying tubes 32 with the appropriate supply bins 31.

The supply of electrical power for the lamp 23, for the work machine 34, etc., is effected via the central region 16, which is free of table tops and which contains the supply lines for all of the work locations. By way of example, FIG. 1 shows a single current-distributing box 40. However, depending upon the type of operation which is to be carried out, further hose and cable lines are also associated with the individual work locations for supplying the same. For example, welding gases must also be supplied for autogenous or oxyacetylene welding. Additional direct current or low-voltage current connections are often also required. To the extent that noxious vapors, such as soldering vapors, are produced at the individual work locations, the latter should be provided with a type of climate control, such as means for withdrawing the gases which result at the work location, and for withdrawing these gases via the central region of the table. Supply of fresh air can also be effected in a similar manner. To the extent that water is meeded at the individual work locations, for example for cooling purposes, the supply and withdraw lines in this case also extend via the central region 16 of the work table.

Finally, it should be noted that any number of tables can be arranged in a circle. Naturally, in a very large circular arrangement, a very large number of individual sector-shaped work tables can be arranged, whereby the relatively large central regions 16 then also results.

The present invention is, of course, in no way restricted to the specific disclosure of the specification and drawings, but also encompasses any modifications within the scope of the appended claims.

What I claim is:

1. An arrangement of work locations for cooperation and working together during the mass production of small, complex units by multiple individuals in a predetermined working cycle, said arrangement having improvement in combination therewith comprising:

a table having a periphery as well as a center and having a basically ring-shaped table top that is divided into individual sectors, each of which provides one of said work locations about the periphery of said table; the center of said table is provided with a central region that is open and free of said table top located exclusively laterally and radially outwardly from said central region as far as to the periphery; and supply lines, such as for power, lighting, gas, air, water, discharge, gas venting, etc., are disposed in said central region for all of said work locations; said table including a plurality of essentially identically-shaped work tables extending laterally outwardly and each having a trapezoidal table top that includes slanted edges which abut one another to form said ring-shaped configuration; and said work tables are disposed extending laterally and radially outwardly from said central region as far as to the periphery as work area located around said open central region to delimit said open central region;

said arrangement further including a portion of a climate-control device disposed in said central region of said table, said climate-control device including suction lines extending to the work areas for removal of solder vapors therefrom; said arrangement, for defining said individual work locations, further including vertically upwardly projecting, radially directed partitions on said table top; material-transfer openings provided in said partitions to establish communication laterally between adjacent ones of said work locations, said partitions being made of transparent plastic material to aid in cooperation and working together by the individuals; and a shelf that at least partially covers said central region of said table; said partitions having upper edges above and remote from said table top, with said shelf being supported on said upper edges above and spaced inwardly of the work areas.

2. An arrangement in combination according to claim 1, which includes a centrally located single current-distributing box as well as a portion of a climate-control device disposed radially outwardly of said box in said central region of said table.

3. An arrangement in combination according to claim 2, in which said climate-control device includes said suction lines extending into proximity of the work areas for removal of the solder vapors from the work areas.

4. An arrangment in combination according to claim 2, which, for defining said individual work locations, includes vertically upwardly projecting, radially directed partitions on said table top; material-transfer openings are provided in and extending through said partitions to establish communication between adjacent ones of said work locations.

5. An arrangement in combination according to claim 4, in which said partitions are radially outwardly directed and extend vertically above junctures laterally adjoining trapezoidal table tops.

6. An arrangement in combination according to claim 5, in which said partitions are made entirely of plastic.

7. An arrangement in combination according to claim 5, which includes a shelf that completely covers said central region of said table.

8. An arrangement in combination according to claim 7, in which said partitions have a chute extending inclined through said material-transfer openings.

* * * * *

UNITED STATES PATENT AND TRADEMARK OFFICE

CERTIFICATE OF CORRECTION

PATENT NO. : 4,807,540

DATED : Feb. 28, 1989

INVENTOR(S) : Wolfgang Priesemuth

It is certified that error appears in the above-identified patent and that said Letters Patent is hereby corrected as shown below:

On the title-abstract page, the following should be added:

[30] Foreign Application Priority Data

20 Feb. 1985 [DE] German Patent Application Ser.No. P 3505763

Signed and Sealed this

Third Day of October, 1989

*Attest:*

*Attesting Officer*

DONALD J. QUIGG

*Commissioner of Patents and Trademarks*